US005292228A

United States Patent [19]

Dye

[11] Patent Number: 5,292,228

[45] Date of Patent: Mar. 8, 1994

[54] CEILING FAN SUPPORT

[76] Inventor: David L. Dye, 3541 High Countryside Dr., Grapevine, Grapevine County, Tex. 76051

[21] Appl. No.: 913,606

[22] Filed: Jul. 13, 1992

[51] Int. Cl.[5] ..... F04D 29/14

[52] U.S. Cl. ..... 416/5; 248/318; 362/253; 362/404; D23/377; D23/385

[58] Field of Search ..... 416/5; 248/318; 362/96, 362/253, 404, 405; D23/411, 377, 379, 385

[56] References Cited

U.S. PATENT DOCUMENTS

| | | | |
|---|---|---|---|
| D. 235,399 | 6/1975 | Malnedoff | D6/513 |
| D. 295,555 | 5/1988 | Greenberg . | |
| D. 297,360 | 8/1988 | Cheslock . | |
| D. 297,456 | 8/1988 | Pearce . | |
| D. 297,859 | 9/1988 | Jiang . | |
| D. 297,974 | 10/1988 | Sonneman . | |
| D. 298,052 | 10/1988 | Sonneman . | |
| D. 298,454 | 11/1988 | Clyde-Mason . | |
| D. 303,425 | 9/1989 | Sonneman . | |
| D. 312,868 | 12/1990 | Rezek . | |
| 332,821 | 12/1885 | Murray, Jr. | 415/5 |
| 1,344,452 | 6/1920 | Roth | 248/318 |
| 3,228,577 | 1/1966 | Croft | 248/318 |
| 4,342,073 | 7/1982 | Ranten | 362/404 |
| 4,796,166 | 1/1989 | Greenberg . | |
| 4,884,947 | 12/1989 | Rezek | 415/5 |
| 5,028,206 | 7/1991 | Kendregan et al. | 362/96 |

FOREIGN PATENT DOCUMENTS

| | | | |
|---|---|---|---|
| 238595 | 9/1911 | Fed. Rep. of Germany | 362/405 |

OTHER PUBLICATIONS

Craftmade International, Inc. Catalog, 1988, pp. 23-25.

Craftmade International, Inc. Presidential series Brochure, 1988.

*Primary Examiner*—Edward K. Look

*Assistant Examiner*—Michael S. Lee

*Attorney, Agent, or Firm*—Harold E. Meier

[57] ABSTRACT

A ceiling fan includes a ceiling support plate; a plurality of support arms extending downwardly in a cone-shaped, triangular pattern from the ceiling support plate; and a bowl-shaped housing suspended from the support arms and housing the fan motor. A bowl-shaped fan motor cover mounted in the housing covers the fan motor and decorative trim is mounted to the base of the support member and on the support arms to create an aesthetically pleasing appearance. Tubular lights are mounted around the interior perimeter of the housing to provide indirect lighting in a room.

12 Claims, 4 Drawing Sheets

CEILING FAN SUPPORT

TECHNICAL FIELD

This invention relates to ceiling fan assemblies and more particularly to supports for ceiling fans.

BACKGROUND OF THE INVENTION

Ceiling fans are widely used to facilitate air flow in a room and maintain a comfortable temperature. After installation, a ceiling fan is often considered a part of the interior design of a room. Therefore, it is desirable for the ceiling fan to have an aesthetically pleasing appearance, with as many of the functional components obscured from view as possible.

One problem with providing an aesthetically pleasing appearance is placement of the fan motor on the ceiling fan. In most prior art ceiling fans, the fan motor is visible to the casual observer. There is a need for a ceiling fan assembly wherein the motor is not clearly visible to the casual observer.

A second problem with prior art ceiling fan assemblies is inadequate lighting. Ceiling fans are commonly installed in preexisting light outlets. Ceiling fan manufacturers usually offer an optional lighting kit so that a ceiling fan purchaser does not gain air circulation at the expense of room illumination. In addition to being an additional expense for the purchaser, the lights are designed to be positioned at the base of the ceiling fan. There is a need for a ceiling fan assembly that provides a light fixture without the additional cost of purchasing a lighting kit, and that includes lights positioned to provide an optimal level of light in a room.

SUMMARY OF THE INVENTION

The present invention comprises a ceiling fan support which overcomes the foregoing disadvantages associated with the prior art.

A ceiling fan support in accordance with the present invention includes a ceiling plate attachable to a ceiling outlet. Multiple support arms having decorative trim mounted thereto extend downwardly from the ceiling plate in a cone-shaped, triangular pattern. A bowl-shaped housing is suspended from the support arms. Attachment means fasten the support arms to the housing and to the ceiling plate.

A motor mounted to the base of the housing drives the blades of the ceiling fan. A rotatable armature as a part of the motor protrudes through an opening in the base of the housing and attaches to multiple fan blades. A lighting fixture is mounted on the interior surface of the housing.

DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
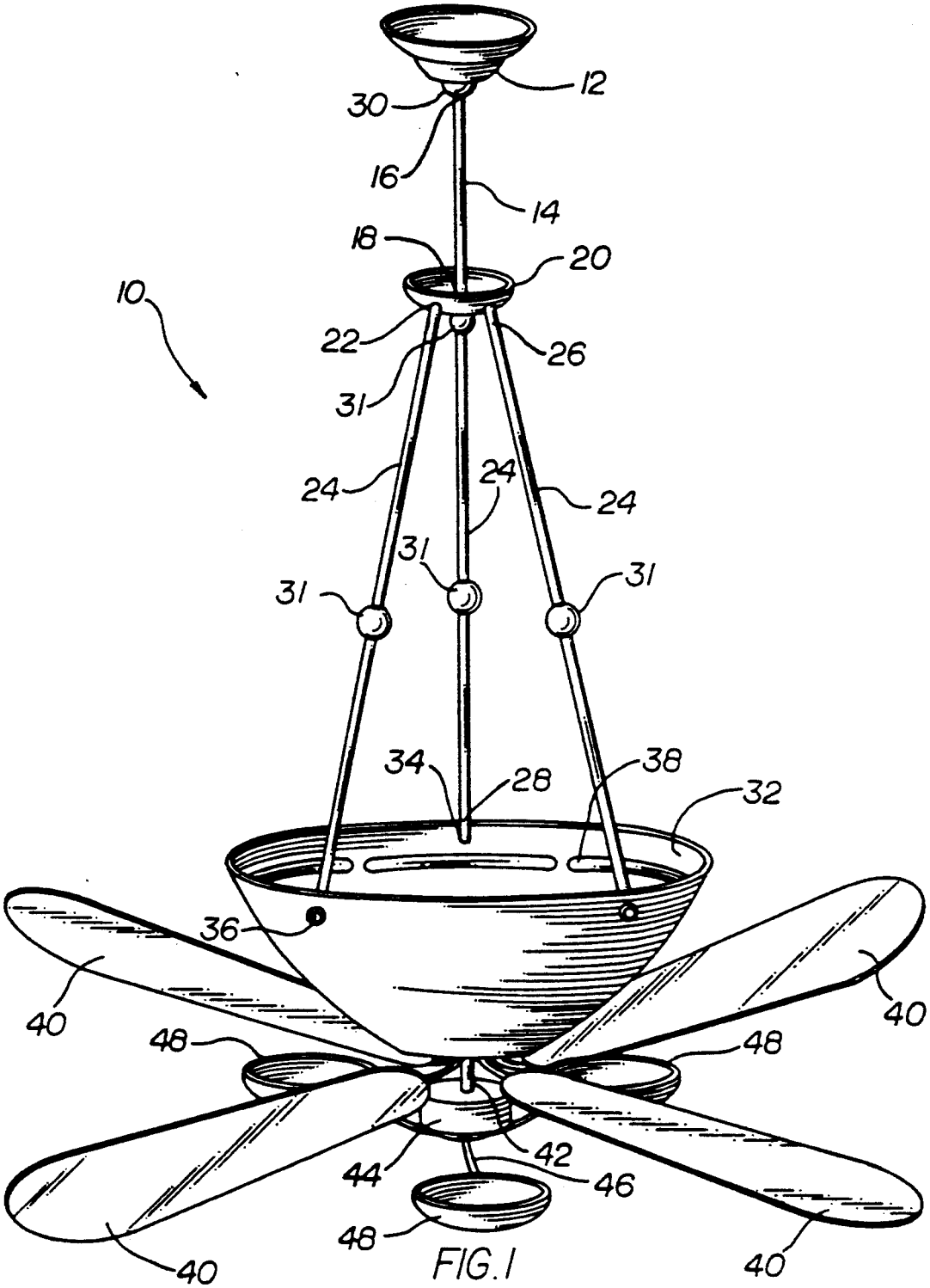
FIG. 1 is a perspective view of a first embodiment of a ceiling fan support according to the present invention.
Figure 2:
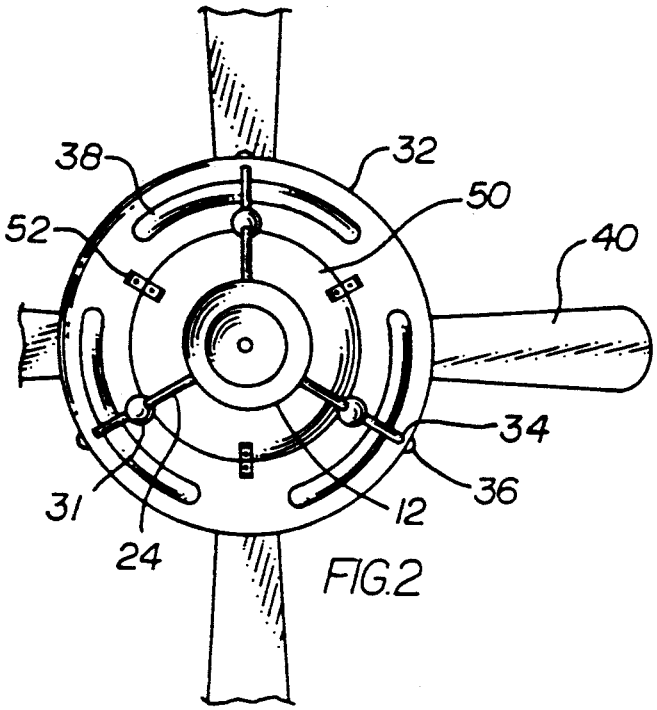
FIG. 2 is a top view of the ceiling fan support illustrated in FIG. 1.
Figure 3:
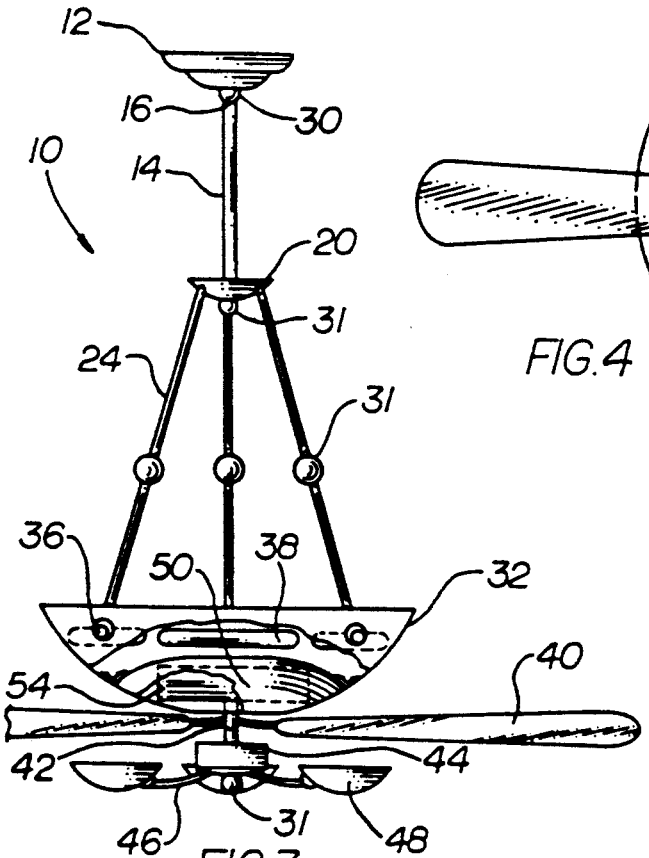
FIG. 3 is a cut-away side view of the ceiling fan support illustrated in FIG. 1, showing the fan motor housing and the fan motor.
Figure 4:
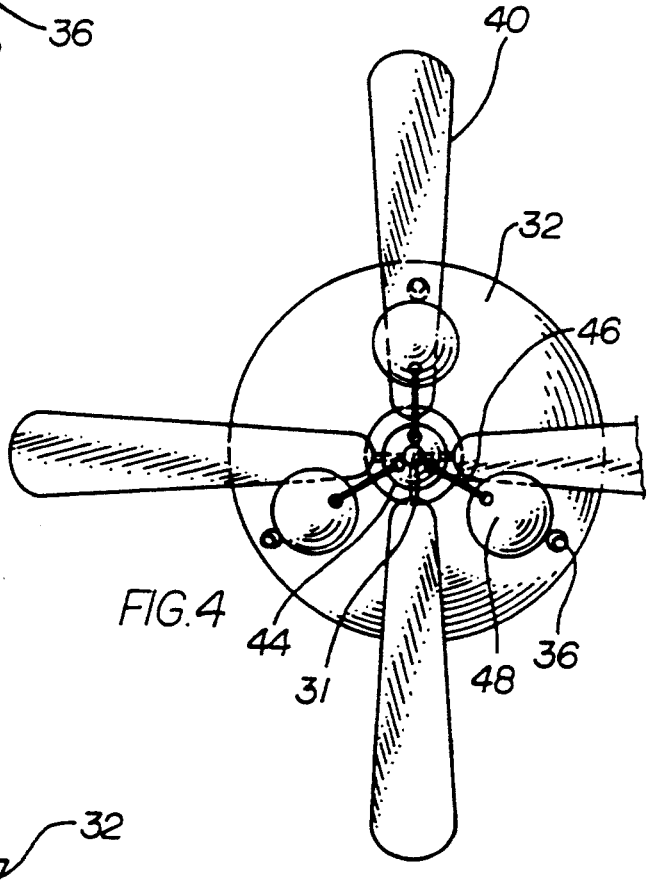
FIG. 4 is a bottom view of the ceiling fan support illustrated in FIG. 1.

Referring now to the Drawings, wherein like reference characters designate like or similar parts throughout the six views, FIG. 1 is a perspective view of a first embodiment 10 of a ceiling fan support according to the present invention.

Referring to FIGS. 1, 2, 3 and 4, a ceiling attachment member 12 attaches to the ceiling with fastening means (not shown) known in the art. Although a bowl-shaped ceiling attachment member 12 is illustrated in FIG. 1, it will be understood that the ceiling attachment member may have various shapes.

Decorative trim of various shapes and designs may be mounted to the ceiling attachment member 12 and other components of the ceiling fan support. The decorative trim may be manufactured of brass, crystal, porcelain, wood, or other decorative materials known in the art. In FIG. 1, a conventional "hanging straight" ball 30 is a part of the base of the ceiling attachment member 12.

A support rod 14 having a first end 16 and a second end 18 is secured to the ceiling attachment member 12. The first end 16 of the rod 14 attaches to the hanging straight ball 30 at the base of the ceiling attachment member 12. The second end 18 of the rod 14 attaches to the interior surface of a support member 20. The support rod 14 may have various lengths, depending on the desired position of the ceiling fan from the ceiling.

If the ceiling fan support 10 does not include the ceiling attachment member 12 and support rod 14, the support member 20 attaches directly to the ceiling. Although it is bowl-shaped in FIGS. 1–4, the support member 20 may have various shapes. A plurality of openings 22 are disposed around the perimeter of the support member 20. A decorative ball 31 is a part of the base of the support member 20.

Multiple support arms 24 extend downwardly in a cone-shaped, triangular pattern from the support member 20. The first end 26 of the support arm 24 protrudes through the opening 22 and mounts to the interior surface of the support member 20 via a nut (not shown) or another selected fastener. Alternatively, the openings 22 in the support member 20 may be omitted and the support arm 24 fastened directly, e.g. welded, to the exterior surface of the support member.

Multiple decorative balls 31 are affixed along the axis of the support arms 24. In FIGS. 1–4, a decorative ball is mounted in the center of each support arm 24, however, the decorative balls may be positioned anywhere along the support arms as desired. Various types of decorative trim may be substituted for the balls shown.

A bowl-shaped housing 32 is suspended from the support arms 24. Although similarly shaped, the housing 32 is larger than the support member 20 and ceiling attachment member 12. The housing 32 is designed to provide an aesthetically decorative appearance. Such housing may be constructed of glass, wood, metal or other selected decorative materials, and may be tinted or plated a specific color. Various decorative trims, such as scrolling, may be added as desired.

Multiple openings 34 are disposed in the housing 32 around its perimeter. The number of openings 34 in the housing 32 corresponds to the number of support arms 24. The second end 28 of the support arm 24 extends through the opening 34. A nut 36 or some other fastening means on the exterior surface of the housing 32 mounts the support arm 24 to the housing.

A fan motor 54 (see FIG. 3) mounts inside the housing 32. The fan motor 54 is mounted inside the housing 32 by one of several fixtures. The first fixture uses a bowl-shaped fan motor cover 50 (see FIGS. 2 and 3) mounted in the housing 32. The fan motor cover 50 is fastened to the interior surface of the housing 32 using brackets 52, bolts or some other selected fastener. The fan motor 54 is positioned underneath and secured to the fan motor cover 50. In an alternative, the fan motor 54 is bolted or otherwise fixed to the base of the housing 32 with no cover. Using either fixture, the fan motor 54 is obscured from view of the casual observer by the housing 32.

Tubular lights 38 are mounted to the interior surface of the housing 32 adjacent the openings 34. Low-glare lights commonly used in indirect lighting are desirable. These light sources may be standard Edison base for standard household bulb use (60A19, for example). Halogen bulbs are also available and the new "PL" plug-in fluorescents could be used. If a purchaser does not acquire a lighting kit with the ceiling fan assembly, the tubular lights or other selected lights provide indirect illumination for the room.

A hollow rotatable armature (not shown) as a part of the fan motor 54 extends downwardly from the fan motor within the base of the housing 32. Multiple fan blades 40 having attachment means are mounted to and extend radially from the armature. Wiring for a light fixture extends upwardly through the armature and through an opening in the fan motor 54.

As an option, a circular lighting support member 44 is mounted to a second end of a support rod 42 extending through an opening in the rotatable armature. The lighting support member 44 is positioned beneath the fan blades 40 such that the fan blades rotate without contacting the lighting support member.

Support arms 46 extend radially from the base of the lighting support member 44. A decorative ball (see FIGS. 3 and 4) is fixed to the base of the lighting support member 44.

Bowl-shaped light holders 48 attach to the ends of support arms 46. The light holders 48 hold light bulbs (not shown), such as 75*w* mini-can halogen satin white glass bulbs. If the purchaser selects a ceiling fan assembly including this option, there will be two sources of light on the ceiling fan to provide illumination for the room.

Figure 5:
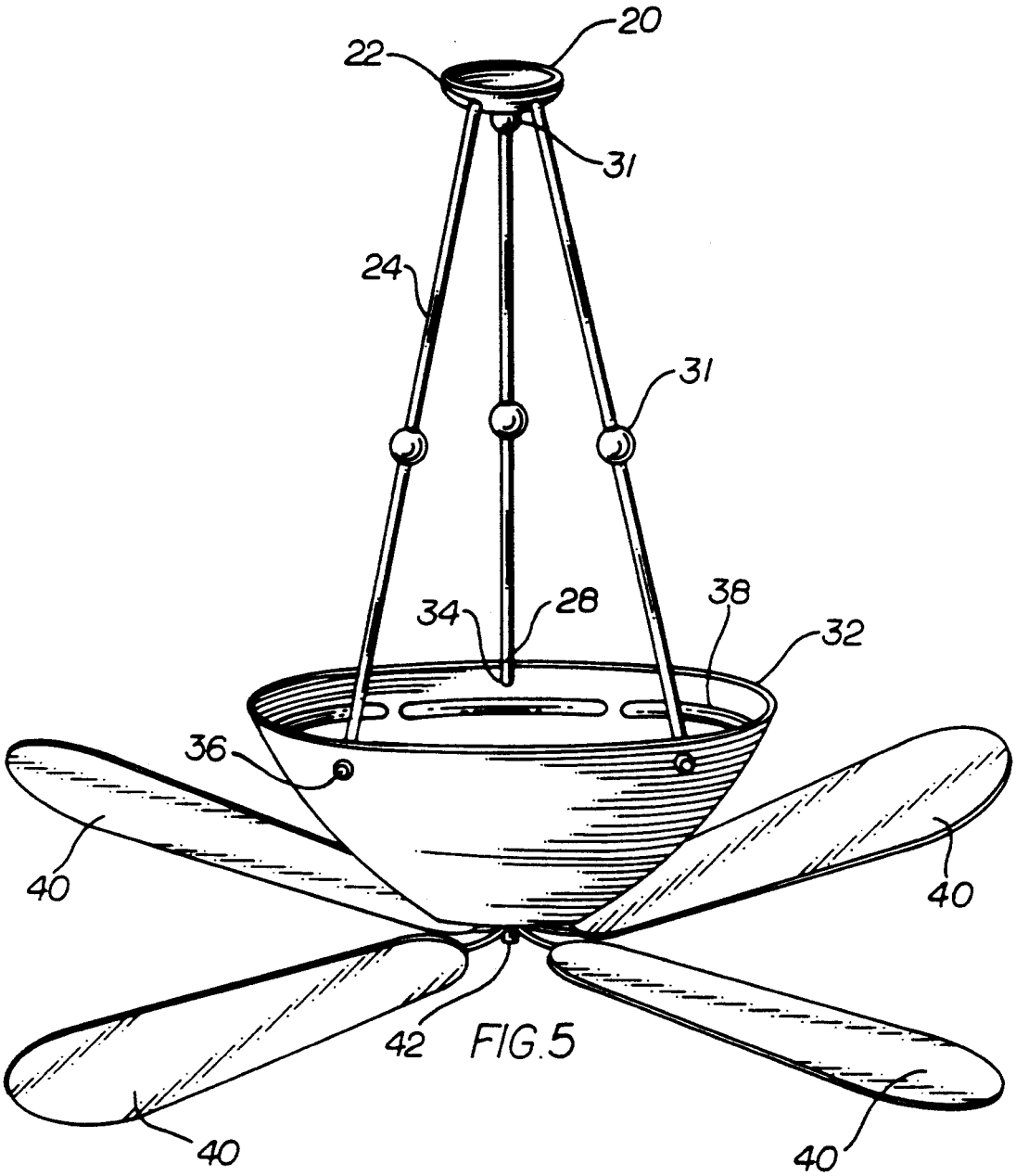
FIG. 5 is a perspective view of a second embodiment of the ceiling fan support of the present invention.

FIG. 5 illustrates a perspective view of a second embodiment of the ceiling fan support of the present invention. In this embodiment, a support member 20 attaches directly to the ceiling and support arms 24 extend downwardly in a cone-shaped, triangular pattern from the support member.

The first end of the support arm 24 protrudes through an opening 22 in the support member 20. The support arms 24 are secured to the interior surface of the support member 20 with nuts (not shown) or other selected fasteners.

The second end 28 of the support arm 24 protrudes through a similar opening 34 in a housing 32. The support arms 24 are secured to the housing 32 via nuts 36 disposed on the exterior surface of the housing. Tubular or other desired lights 38 are spaced around the perimeter of the housing 32. Decorative balls 31 are mounted to the base of the support member 20 and along the axis of the support arms 24.

A rotatable armature as a part of the fan motor (not shown) extends downwardly through an opening in the base of the housing 32. Fan blades 40 extend radially from the rotatable armature.

Figure 6:
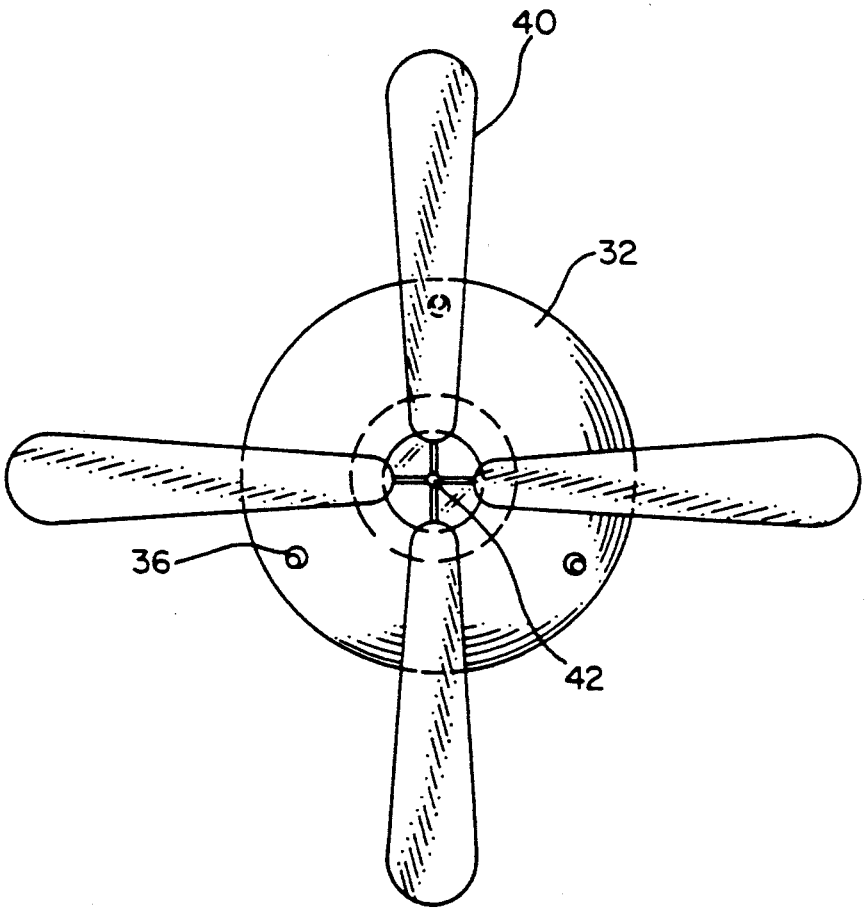
FIG. 6 is a bottom view of the ceiling fan support illustrated in FIG. 5.

Turning to FIG. 6, there is shown a bottom view of the ceiling fan support illustrated in FIG. 5. Fan blades 40 extend radially from an armature (not shown) as a part of the fan motor (not shown). Nuts 36 mounted on the second end of the support arms (not shown) secure the support arms to a housing 32. The fan motor cover, fan motor and tubular lights (not shown) are mounted inside the housing 32.

Although preferred and alternative embodiments of the present invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A ceiling fan, comprising:

a support member including a plurality of support openings;

a plurality of rigid support arms extending downwardly in a cone-shaped pattern from the support member, the first end of each support arm extending through a support opening in the support member;

a bowl-shaped housing having a rim thereof positioned toward said support member and the base thereof positioned away from said support member, said housing suspended from the second end of the support arms, said housing including a plurality of support openings and an opening in the base thereof;

fastening means for mounting the support arms to the support member and housing through the support openings;

a fan motor mounted to and supported only by the bowl-shaped housing below the rim thereof for driving a plurality of fan blades;

a rotatable armature as a part of said fan motor, the rotatable armature extending downwardly at the opening in the base of the housing;

a plurality of fan blades; and a plurality of attachment means, each having one end fastened to an end of one blade, said attachment means extending through the opening in the base of said housing for attachment to the rotatable armature.

2. The ceiling fan of claim 1 including decorative trim comprising decorative balls.

3. The ceiling fan of claim 1 including a bowl-shaped fan motor cover mounted in said housing.

4. The ceiling fan of claim 1 including lighting means mounted within said housing.

5. The ceiling fan of claim 1 including a lighting means mounted to the fan motor.

6. A ceiling fan, comprising:

a ceiling attachment member, said ceiling attachment member having a hang straight ball mounted to the base thereof;

a ceiling arm having first and second ends, the first end mounted to the ceiling attachment member;

a bowl-shaped support member mounted to the second end of the ceiling arm, the support member including a plurality of openings along the perimeter thereof, and a decorative ball mounted to the base thereof;

a plurality of support arms extending downwardly in a cone-shaped pattern from the support member, the first end of each support arm extending through an opening in the support member;

a bowl-shaped housing suspended from the second end of the support arms, said housing including a plurality of openings along the perimeter and an opening in the base thereof;

fastening means for mounting the support arms to the support member and housing;

a fan motor mounted within the bowl-shaped housing for driving a plurality of fan blades;

a bowl-shaped fan cover mounted in the housing to cover said fan motor;

attachment means for securing the fan motor cover to the housing;

a plurality of light means disposed within the interior surface of the housing;

a rotatable armature as a part of said fan motor, the rotatable armature extending downwardly at the opening in the base of the housing;

a plurality of fan blades having attachment means on one end of each blade, said attachment means extending through the opening of the housing for attachment to the rotatable armature;

a support rod extending through an opening in the rotatable armature;

a lighting support member mounted to the support rod, said lighting support member having a decorative ball mounted to the base thereof;

a plurality of support arms extending radially from the lighting support member; and a plurality of bowl-shaped light holders mounted to one end of the lighting support arms.

7. A ceiling fan, comprising:

a support member including a plurality of support openings;

a plurality of rigid support arms extending downwardly in a cone-shaped pattern from the support member, the first end of each support arm extending through a support opening in the support member;

a bowl-shaped housing suspended from the second end of the support arms, said housing including a plurality of support openings and an opening in the base thereof;

fastening means for mounting the support arms to the housing and to the support member;

a fan motor mounted to and supported only by the bowl-shaped housing below the rim thereof for driving a plurality of fan blades;

a rotatable armature as a part of said fan motor, the rotatable armature extending downwardly at the opening in the base of the housing;

a plurality of fan blades;

attachment means on one end of each blade, said attachment means extending through the opening in the base of the housing for attachment to the rotatable armature; and lighting means mounted within said housing.

8. The ceiling fan of claim 7 including a light support member attached to said fan motor and lighting means mounted to said lighting support member positioned beneath said fan blades.

9. The ceiling fan of claim 8 wherein said lighting means includes a plurality of support arms extending radially from the lighting support member and a plurality of bowl-shaped light holders mounted to one end of the lighting support arms.

10. A ceiling fan, comprising:

a ceiling attachment member, said ceiling attachment member having a hang straight ball mounted to the base thereof;

a ceiling arm having first and second ends, the first end mounted to the ceiling attachment member;

a bowl-shaped support member mounted to the second end of the ceiling arm, the support member including a plurality of openings along the perimeter thereof;

a plurality of support arms extending downwardly in a cone-shaped pattern from the support member, the first end of each support arm extending through an opening in the support member;

a bowl-shaped housing suspended from the second end of the support arms, said housing including a plurality of openings along the perimeter and an opening in the base thereof;

fastening means for mounting the support arms to support member and housing;

a fan motor mounted within the bowl-shaped housing for driving a plurality of fan blades;

a plurality of light means disposed within the interior surface of the housing;

a rotatable armature as a part of said fan motor, the rotatable armature extending downwardly at the opening in the base of the housing; and a plurality of fan blades having attachment means on one end of each blade, said attachment means extending through the opening of the housing for attachment to the rotatable armature.

11. The ceiling fan of claim 10 including:

a support rod extending through an opening in the rotatable armature;

a lighting support member mounted to the support rod, said lighting support member having a decorative ball mounted to the base thereof;

a plurality of support arms extending radially from the lighting support member; and a plurality of bowl-shaped light holders mounted to one end of the lighting support arms.

12. The ceiling fan of claim 10 including:

a bowl-shaped fan cover mounted in the housing to cover said fan motor; and attachment means for securing the fan motor cover to the housing.

* * * * *